US008430352B2

(12) United States Patent
Takahashi

(10) Patent No.: US 8,430,352 B2
(45) Date of Patent: Apr. 30, 2013

(54) ROLL MEDIUM FEEDING APPARATUS AND RECORDING APPARATUS

(75) Inventor: Yoji Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 272 days.

(21) Appl. No.: 13/020,454

(22) Filed: Feb. 3, 2011

(65) Prior Publication Data

US 2011/0206439 A1 Aug. 25, 2011

(30) Foreign Application Priority Data

Feb. 24, 2010 (JP) ..... 2010-039235

(51) Int. Cl.
*B65H 18/14* (2006.01)

(52) U.S. Cl.
USPC ..... 242/542.3; 400/613

(58) Field of Classification Search ..... 400/611, 400/613, 641, 693; 242/542.3; 347/222
See application file for complete search history.

(56) References Cited

U.S. PATENT DOCUMENTS

| | | | | |
|---|---|---|---|---|
| 4,641,980 | A * | 2/1987 | Matsumoto et al. | 400/693 |
| 5,528,278 | A * | 6/1996 | Takizawa et al. | 347/218 |
| 6,474,883 | B1 | 11/2002 | Kawakami et al. | |
| 8,157,462 | B2 * | 4/2012 | Hirabayashi | 400/693.1 |

FOREIGN PATENT DOCUMENTS

| | | | |
|---|---|---|---|
| JP | 11-198471 | A | 7/1999 |
| JP | 2001-158141 | A | 6/2001 |
| JP | 2009-226696 | A | 10/2009 |

* cited by examiner

*Primary Examiner* — Sang Kim
(74) *Attorney, Agent, or Firm* — Global IP Counselors, LLP

(57) ABSTRACT

A roll medium feeding apparatus includes a roll medium accommodating unit including a bearing that supports a shaft member of a roll medium, and a drawer member configured to slide relative to the roll medium accommodating unit. First support surfaces configured to support ends of the shaft member are provided to the roll medium accommodating unit so as to extend in a direction in which the drawer member slides from the bearings, and second support surfaces configured to support the ends of the shaft member are provided to the drawer member so as to intersect with the first support surfaces at an obtuse angle relative to a direction in which the shaft member extends.

6 Claims, 8 Drawing Sheets

ROLL MEDIUM FEEDING APPARATUS AND RECORDING APPARATUS

CROSS-REFERENCE TO RELATED APPLICATIONS

This application claims priority to Japanese Patent Application No. 2010-039235 filed on Feb. 24, 2010. The entire disclosure of Japanese Patent Application No. 2010-039235 is hereby incorporated herein by reference.

BACKGROUND

1. Technical Field

The present invention relates to a recording apparatus such as an inkjet printer, for example, and a roll medium feeding apparatus provided to the recording apparatus.

2. Related Art

Generally, inkjet printers are widely known as recording apparatuses for performing a recording process on a roll medium (Japanese Laid-Open Patent Application No. 2009-226696, for example). In the printer of Japanese Laid-Open Patent Application No. 2009-226696, a sliding stand (drawer member) for holding roll paper (the roll medium) is mounted so as to be capable of sliding relative to a roll paper accommodating unit (roll medium accommodating unit) provided inside a casing. In other words, in this printer, roll paper can be taken in and out of the roll paper accommodating unit by slidably moving the sliding stand so that the roll paper can be replaced.

The sliding stand supports the ends of a winding core roller (a shaft member) of the roll paper by support grooves (bearings) provided to left and right side walls of the sliding stand. The roll paper is pulled out of the roll paper accommodating unit and conveyed toward a printing portion (a recording unit) by rotatably driving conveying drive rollers which sandwich the roll paper between two crimping rollers inside the casing.

SUMMARY

In the printer of Japanese Laid-Open Patent Application No. 2009-226696, the support grooves provided to the sliding stand are designed to function as bearings of the winding core roller of the roll paper. Therefore, when the roll paper is conveyed while being unwound toward the printing portion by rotatably driving the winding roller, drive means for rotatably driving the winding core roller must be provided to the sliding stand, but it has been extremely difficult to provide such drive means to the slidably moving sliding stand.

Therefore, consideration has been given to providing the bearings of the winding core roller and the drive means for rotatably driving the winding core roller to the sides of the roll paper accommodating unit inside the casing. However, in such cases, there have been problems in that it is difficult to move the winding core roller, which is made heavier with the roll paper wound thereon, from the sliding stand to the bearings on the sides of the roll paper accommodating unit.

The present invention was devised in view of such problems inherent in the prior art. An object thereof is to provide a roll medium feeding apparatus and a recording apparatus in which is it possible to smoothly move a roll medium from a drawer member which can slide relative to a roll medium accommodating unit while the shaft member of the roll medium is being support, to the roll medium accommodating unit provided with bearings for supporting the shaft member of the roll medium.

To achieve the objects described above, the roll medium feeding apparatus according to a first aspect of the present invention includes a roll medium accommodating unit including a bearing that supports a shaft member of a roll medium, and a drawer member configured to slidably move relative to the roll paper accommodating unit. The roll medium accommodating unit includes first support surfaces configured to support ends of the shaft member, the first support surfaces extending in a direction in which the drawer member slides from the bearing. The drawer member includes second support surfaces configured to support the ends of the shaft member, the second support surfaces intersecting with the first support surfaces at an obtuse angle relative to a direction in which the shaft member extends.

According to the above-described aspect of the invention, since the second support surfaces intersect with the first support surfaces at obtuse angles as seen from the extending direction of the shaft member, the impact when the shaft member of the roll medium is moved from the second support surfaces to the first support surfaces can be effectively reduced. Therefore, it is possible to smoothly move the roll medium from the drawer member which can slide relative to the roll medium accommodating unit while the shaft member of the roll medium is being supported, to the roll medium accommodating unit provided with bearings for supporting the shaft member of the roll medium.

In the roll medium feeding apparatus according to a second aspect, the second support surfaces are preferably inclined so that a surface portion closer to the roll medium accommodating unit is lower in a direction of gravity than a surface portion farther away from the roll medium accommodating unit.

According to the above-described aspect of the invention, since the shaft member rolls toward the first support surfaces due to its own weight merely by placing the shaft member of the roll medium on the second support surfaces, the shaft member can be easily moved from the second support surfaces to the first support surfaces.

In the roll medium feeding apparatus according to a third aspect, the drawer member preferably includes an accommodating-direction pressing part configured to apply a pressing force to the shaft member, which has changed positions from the second support surfaces to the first support surfaces, the pressing force being applied toward the bearing as the drawer member slidably moves toward the roll medium accommodating unit.

According to the above-described aspect of the invention, the shaft member can be easily led to the bearings because a pressing force toward the bearings can be applied by the accommodating-direction pressing part to the shaft member positioned on the first support surfaces, merely be slidably moving the drawer member toward the roll medium accommodating unit after the shaft member has moved from the second support surfaces to the first support surfaces.

In the roll medium feeding apparatus according to a fourth aspect, the bearing preferably has a bearing surface that regulates the movement of the shaft member in the sliding direction of the drawer member, and holds the shaft member.

According to the above-described aspect of the invention, the shaft member can be held as being positioned in the bearings.

In the roll medium feeding apparatus according to a fifth aspect, the drawer member preferably includes a withdrawing-direction pressing part configured to apply a pressing force in a withdrawing direction to the shaft member supported by the bearing, the pressing force being applied as the drawer member slidably moves in a direction of withdrawing from the roll medium accommodating unit.

According to the above-described aspect of the invention, the shaft member can be easily taken out of the bearings because a pressing force in the withdrawing direction of the drawer member can be applied by the withdrawing-direction pressing part to the shaft member being supported in the bearings, merely by pulling the drawer member out of the roll medium accommodating unit.

The recording apparatus according to a sixth aspect includes the roll medium feeding apparatus configured as described above, and a recording unit that performs a recording process on the roll medium fed from the roll medium feeding apparatus.

According to the above-described aspect of the invention, it is possible to achieve the same operational effects as those described above.

BRIEF DESCRIPTION OF THE DRAWINGS

Referring now to the attached drawings which form a part of this original disclosure.

DETAILED DESCRIPTION OF EXEMPLARY EMBODIMENTS

An embodiment in which the recording apparatus of the present invention is specified as an inkjet printer is described hereinbelow based on the drawings. In the description hereinbelow, when the terms "forward-backward direction," "up-down direction," and "left-right direction" are used, they refer to the "forward-backward direction," "up-down direction," and "left-right direction" indicated by the arrows in FIG. 1 as long as there are no other particular descriptions. In the present embodiment, the up-down direction is defined as the vertical direction (direction of gravity).

Figure 1:
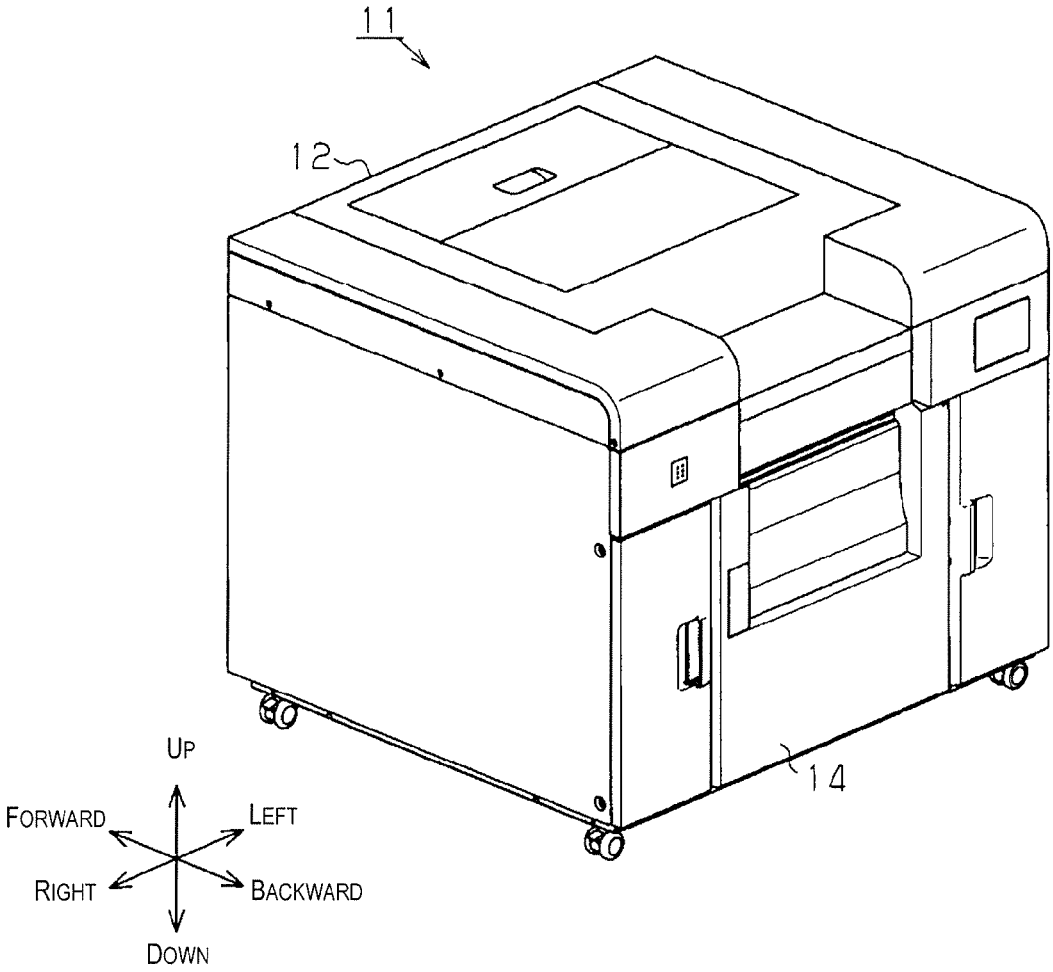
FIG. 1 is a perspective view of an inkjet printer in the embodiment.
Figure 2:
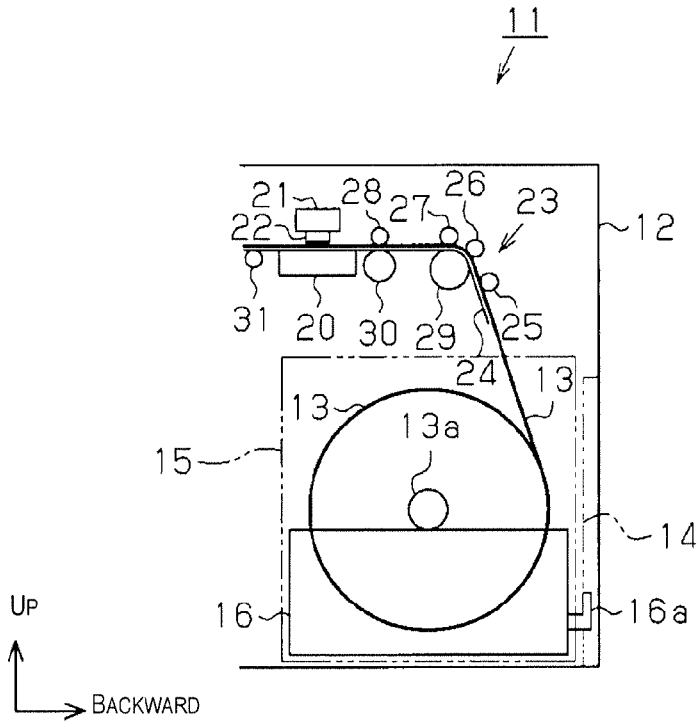
FIG. 2 is a schematic view showing a state when roll paper has been set into the roll paper accommodating unit of the same printer.

An inkjet printer 11 as a recording apparatus comprises a main frame 12 having the shape of a rectangular parallelepiped, as shown in FIGS. 1 and 2. At the bottom of the rear surface of the main frame 12 is provided a door 14 which opens and closes when roll paper 13 as a roll medium is set inside the main frame 12 or when the roll paper 13 set inside the main frame 12 is replaced. Specifically, in a position at the bottom of the main frame 12 interior and on the inner side of the door 14, a roll paper accommodating unit 15 is provided as a roll medium accommodating unit for accommodating the roll paper 13.

Figure 3:
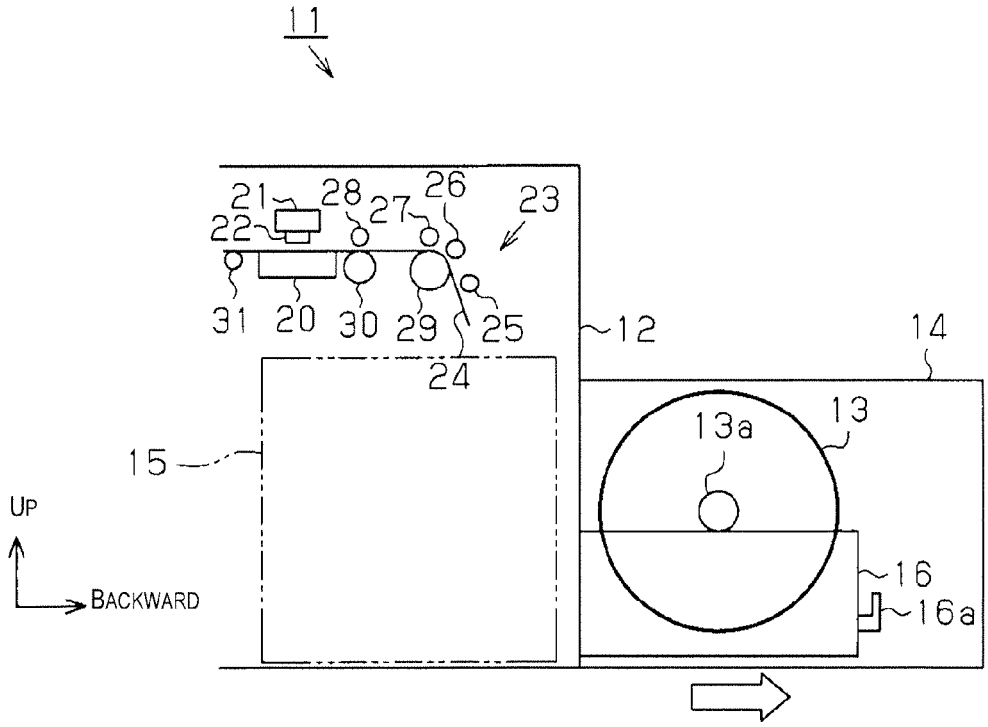
FIG. 3 is a schematic view showing a state when the roll paper has been taken out of the roll paper accommodating unit of the same printer.

The roll paper accommodating unit 15 is provided with a drawer member 16 configured to be capable of sliding in the forward-backward direction (a sliding direction) relative to the roll paper accommodating unit 15 as shown in FIGS. 2 and 3. Specifically, with the door 14 opened, the drawer member 16 can be taken in and out of the roll paper accommodating unit 15. At the bottom of the rear end of the drawer member 16, a handle 16*a* is provided for the user to grasp when slidably moving the drawer member 16.

When a shaft member 13*a* of the roll paper 13 is supported in the drawer member 16 with the drawer member 16 pulled out of the roll paper accommodating unit 15, and the drawer member 16 is then again accommodated back in the roll paper accommodating unit 15, the shaft member 13*a* of the roll paper 13 is supported in the roll paper accommodating unit 15 so as to be capable of rotating about an axis line extending in the left-right direction. The shaft member 13*a* extends in the left-right direction, and the right end thereof is provided with a gear 13*b* (see FIG. 4), described hereinafter.

The position of the drawer member 16 when the drawer member 16 is pulled out of the roll paper accommodating unit 15 (the position shown in FIG. 3) is designated as the pulled-out position, and the position of the drawer member 16 when the drawer member 16 is accommodated in the roll paper accommodating unit 15 (the position shown in FIG. 2) is designated as the accommodated position. In the present embodiment, a roll medium feeding apparatus is configured by the shaft member 13*a* of the roll paper 13, the roll paper accommodating unit 15, and the drawer member 16.

A flat plate-shaped platen 20 for supporting roll paper 13 unwound from the roll paper accommodating unit 15 is disposed in a horizontal state in a position above the roll paper accommodating unit 15 inside the main frame 12, as shown in FIGS. 2 and 3. A carriage 21 is provided above the platen 20 so as to face the platen 20, and a recording head 22 as a recording medium is supported on the underside of the carriage 21. The carriage 21 is configured to be capable of moving back and forth in the left-right direction by drive means (not shown), and ink is supplied to the recording head 22 from an ink cartridge (not shown) disposed inside the main frame 12.

Also provided inside the main frame 12 is a conveying mechanism 23 for conveying the roll paper 13 supported on the roll paper accommodating unit 15 over the platen 20 along a conveying route. The conveying mechanism 23 comprises a guide plate 24 for guiding the roll paper 13 unwound from the roll paper accommodating unit 15 along the conveying route, and conveying rollers 25 to 31 which are set up along the conveying route and which convey the roll paper 13 toward the platen 20.

While the roll paper 13 supported on the roll paper accommodating unit 15 is being sequentially conveyed over the platen 20 by the conveying mechanism 23 and the carriage 21 is being moved back and forth in the left-right direction by the drive means (not shown), ink is sprayed from the recording head 22 onto the roll paper 13 on the platen 20, whereby the recording process of printing is performed on the roll paper 13. After printing, the roll paper 13 is dried by a drying device (not shown) disposed farther downstream along the conveying route than the platen 20, and the roll paper 13 is then sequentially wound by a winding shaft (not shown).

Next, the configuration of the roll paper accommodating unit 15 will be described in detail.

Figure 4:
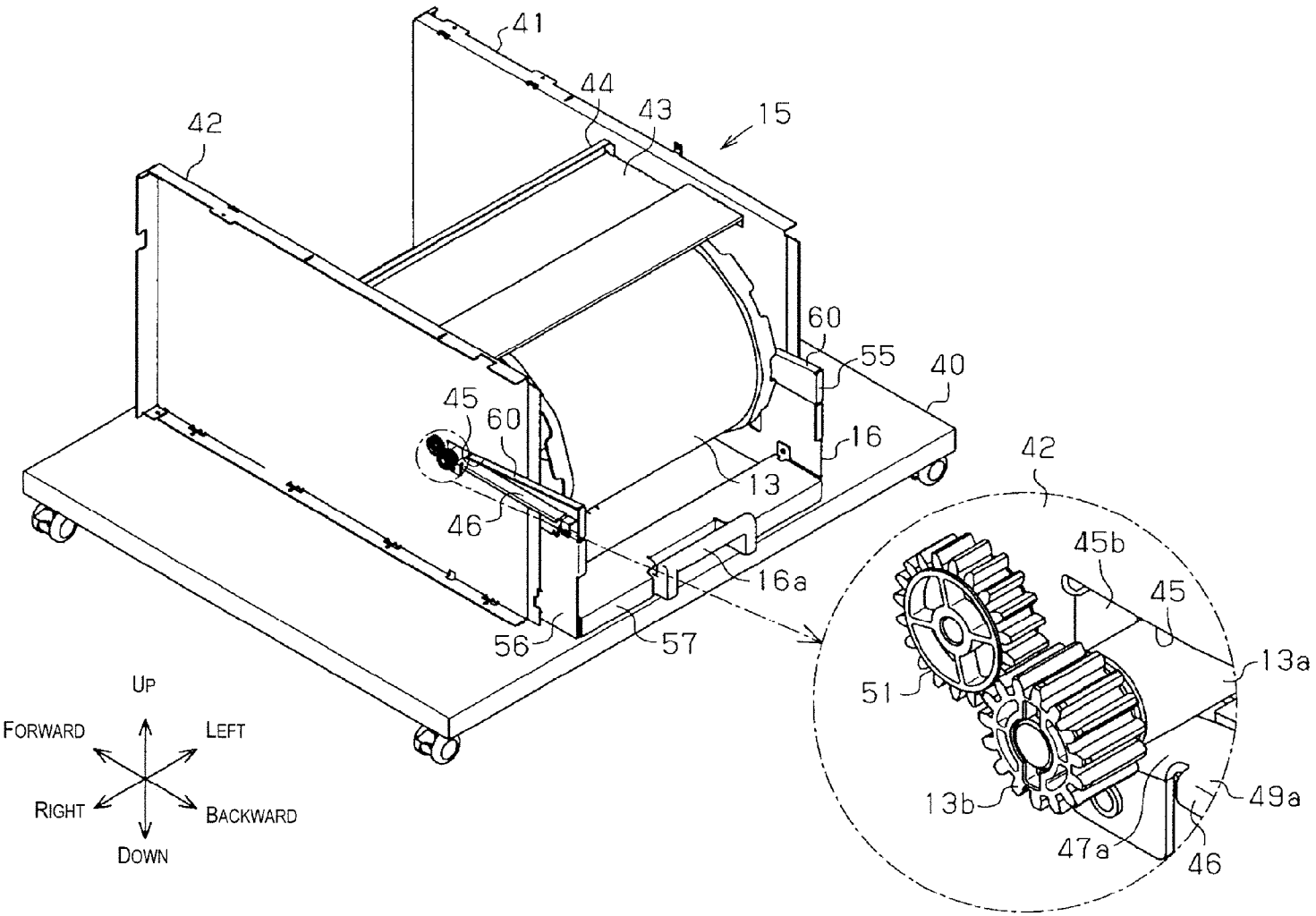
FIG. 4 is a perspective view of the roll paper accommodating unit in the same printer.

The roll paper accommodating unit 15 comprises a pair of rectangular accommodating unit side plates 41, 42 disposed so as to face each other across a predetermined gap in the left-right direction on a flat plate-shaped base 40 of the main frame 12 (see FIG. 1), as shown in FIG. 4. A top plate 43 spans between the top ends of the accommodating unit side plates 41, 42, and a front plate 44 spans between the accommodating unit side plates 41, 42 so as to block off an opening enclosed by the front edge of the top plate 43, the inside surfaces of the accommodating unit side plates 41, 42, and the top surface of the base 40.

Figure 8:
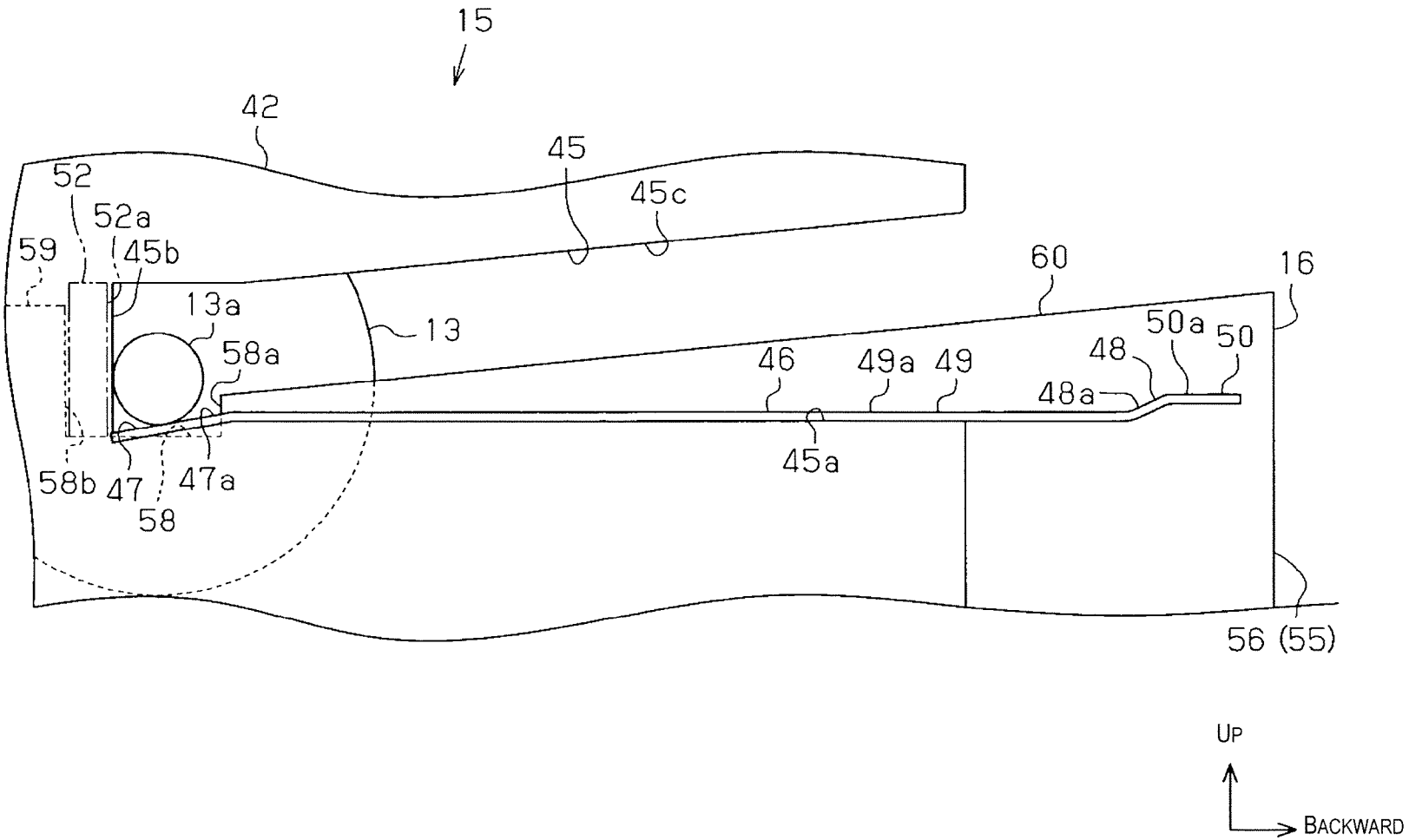
FIG. 8 is a schematic view showing the positional relationship between the drawer member and the roll paper accommodating unit when the drawer member is in the accommodated position in the same printer.

A recessed groove 45 extending in the forward-backward direction is formed in the vertical center of the rear end of the right accommodating unit side plate 42, as shown in FIGS. 4 and 8. The rear end side of the recessed groove 45 is open, while the front end side is closed off. In the bottom surface 45*a* of the recessed groove 45, the front end is inclined so as to lower towards the front, while the rest of the bottom surface 45*a* other than the front end extends horizontally. The front surface 45*b* of the recessed groove 45 extends in the up-down direction, and the top surface 45*c* of the recessed groove 45 extends at an incline so as to rise toward the rear. A belt-shaped support member 46 extending in the forward-backward direction along the bottom surface 45*a* of the recessed groove 45 is provided over the bottom surface 45*a* so as to cover the bottom surface 45*a*.

The front end of the support member 46 is provided with a front inclined part 47 which is inclined along the incline of the front end of the bottom surface 45*a* of the recessed groove 45, while the rear end of the support member 46 protrudes to the rear from the opening in the rear end side of the recessed groove 45. The rear end of the support member 46 is provided with a rear inclined part 48 which is inclined so as to rise toward the rear, and the portion of the support member 46 farther to the rear than the rear inclined part 48 extends horizontally straight toward the rear.

In the support member 46, the horizontal portion between the front inclined part 47 and the rear inclined part 48 is designated as a front horizontal part 49, and the horizontal portion farther to the rear than the rear inclined part 48 is designated as a rear horizontal part 50. On the inside surface (the right surface) of the left accommodating unit side plate 41, a support member 46 similar to the one described above is provided so as to face the support member 46 of the right accommodating unit side plate 42. Furthermore, on the inside surface (the right surface) of the left accommodating unit side plate 41 is provided a contact member 52 having a contact surface 52*a* which faces the front surface 45*b* of the recessed groove 45.

In the present embodiment, first support surfaces capable of supporting the left and right ends of the shaft member 13*a* are configured by the respective top surfaces 49*a*, 48*a*, 50*a* of the front horizontal parts 49, the rear inclined parts 48, and the rear horizontal parts 50 in both support members 46. Furthermore, in the present embodiment, bearing surfaces constituting bearing-parts for regulating the forward and backward movement of the shaft member 13*a* and holding the shaft member 13*a* are configured by the top surfaces 47*a* of the front inclined parts 47, the front surfaces 45*b* of the recessed grooves 45, and the contact surfaces 52*a* of the contact members 52 in both support members 46. Thus, the front incline parts 47, the recessed groves 45 and the contact members 52 constitute a bearing of the roll paper accommodating unit 15 of the present embodiment, which supports the shaft member 13*a* of the roll paper 13.

As shown in FIGS. 4 and 8, a drive gear 51, which can be rotatably driven in two directions about an axis line extending in the left-right direction by a motor (not shown) provided inside the main frame 12, is turnably supported in front of and adjacent to the front surface 45*b* of the recessed groove 45 over the outside surface (the right surface) of the right accommodating unit side plate 42. In a state in which the shaft member 13*a* of the roll paper 13 is supported by the top surfaces 47*a* of the front inclined parts 47 of the support members 46 and the front surfaces 45*b* of the recessed grooves 45, the gear 13*b* of the shaft member 13*a* and the drive gear 51 mesh on the outer side (the right side) of the right accommodating unit side plate 42.

Next, the configuration of the drawer member 16 will be described in detail.

The drawer member 16 comprises a pair of rectangular drawer side plates 55, 56 disposed so as to face each other across a predetermined space, and a rectangular parallelepiped frame 57 spanning between the bottom ends at the rear ends of the drawer side plates 55, 56, as shown in FIG. 4. The width between the drawer side plates 55, 56 is slightly smaller than the width between the accommodating unit side plates 41, 42. Therefore, the drawer member 16 can be inserted in between the accommodating unit side plates 41, 42 from the rear.

The configuration of the drawer side plates 55, 56 is described in detail hereinbelow, but since the drawer side plates 55, 56 have entirely the same configuration, only the configuration of the right drawer side plate 56 will be described.

Figure 5:
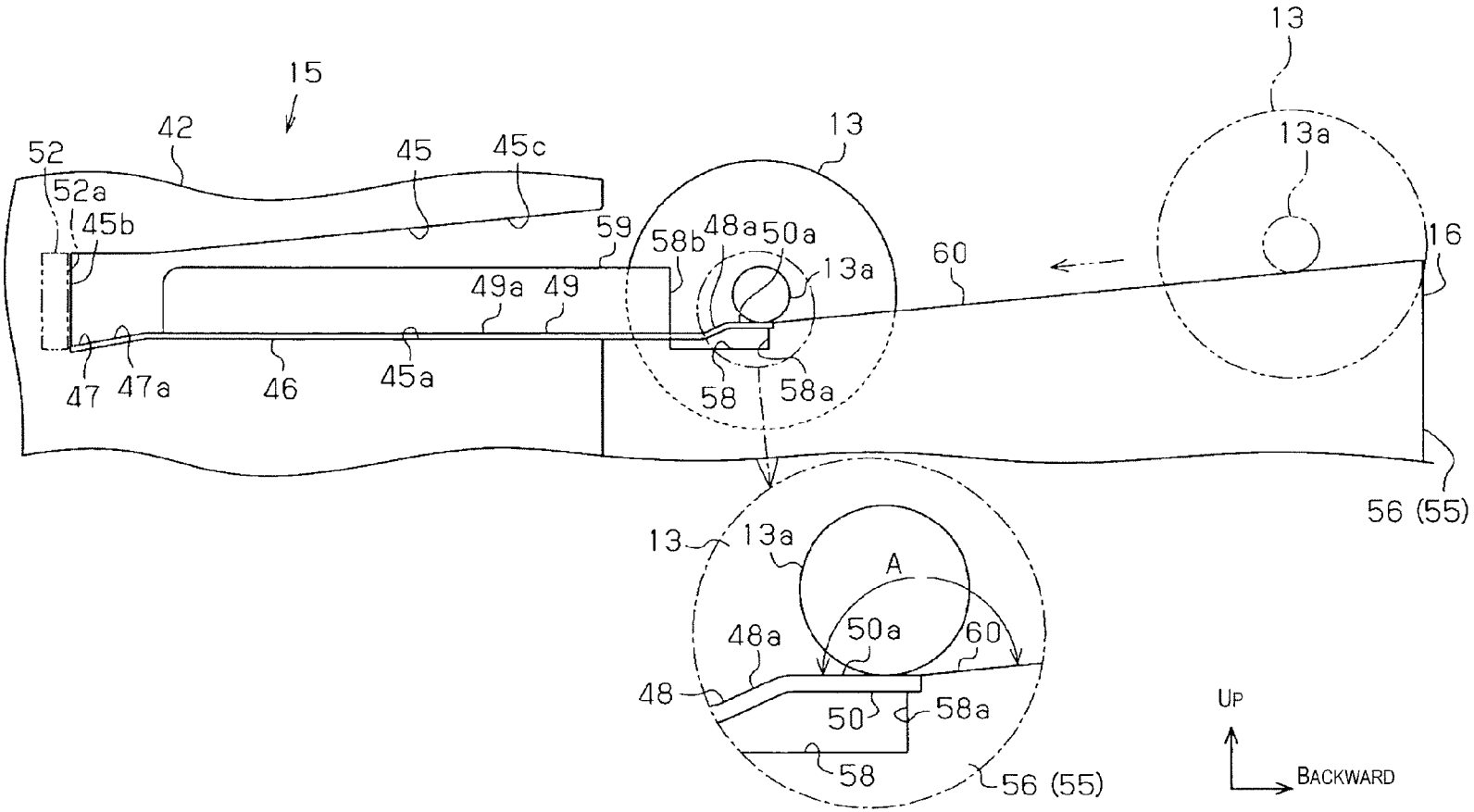
FIG. 5 is a schematic view showing the positional relationship between the drawer member and the roll paper accommodating unit when the drawer member is in the pulled-out position in the same printer.

A concavity 58 is formed in the center of the forward-backward direction in the top surface of the drawer side plate 56, as shown in FIGS. 5 and 8. In the top surface of the drawer side plate 56, the surface in front of the concavity 58 constitutes a drawer horizontal surface 59, which is horizontal, and the surface behind the concavity 58 constitutes a drawer inclined surface 60 (second support surface), which is inclined so as to lower toward the front. In other words, the drawer inclined surface 60 is inclined so that the surface portion nearer the roll paper accommodating unit 15 is lower in the direction of gravity (the up-down direction) than the surface portion farther from the roll paper accommodating unit 15.

The front end of the drawer inclined surface 60 is lower in height than the drawer horizontal surface 59, while the rear end is higher in height than the drawer horizontal surface 59. Therefore, the concavity 58 is designed so that the height of a front surface 58*b* as a withdrawing-direction pressing part is higher than the height of a rear surface 58*a* as an accommodating-direction pressing part. When the drawer member 16 is in the pulled-out position (the position shown in FIG. 5), the rear surface 58*a* of the concavity 58 is in a position corresponding to the rear end of the rear horizontal part 50 of the support member 46.

In this case, the top end of the rear surface 58*a* of the concavity 58 is in a position lower than a top surface 50*a* of the rear horizontal part 50 of the support member 46 and higher than a top surface 49*a* of the front horizontal part 49 of the support member 46. Furthermore, in this case, an angle A formed by the drawer inclined surface 60 and the top surface 50*a* of the rear horizontal part 50 of the support member 46 as seen from the left-right direction is an obtuse angle (about 170 degrees in the present embodiment).

When the drawer member 16 is in the accommodated position (the position shown in FIG. 8), the distance between the rear surface 58*a* and the front surface 58*b* in the concavity 58 of the drawer side plate 56 is longer than the distance between the rear surface 58*a* and the front surface 45*b* of the recessed groove 45. In this case, the distance between the rear surface 58*a* of the concavity 58 and the front surface 45*b* of the recessed groove 45 is slightly longer than the outside diameter of the shaft member 13*a*. In the present embodiment, second supporting surfaces capable of supporting the ends of the shaft member 13*a* are configured by the drawer inclined surfaces 60 of the drawer side plates 55, 56.

Next, the action of setting the roll paper 13 in the inkjet printer 11 will be described.

When the roll paper 13 is set in the inkjet printer 11, first, with the door 14 open, the drawer member 16 accommodated in the roll paper accommodating unit 15 is pulled out rearward in the withdrawing direction, thereby moving the drawer member 16 from the accommodated position to the pulled-out position. The ends of the shaft member 13*a* are then placed on the drawer inclined surfaces 60 of the drawer side plates 55, 56 of the drawer member 16 so that the roll paper 13 is disposed between the drawer side plates 55, 56, as shown in FIG. 5.

The shaft member 13*a* then rolls forward over the drawer inclined surfaces 60 of the drawer side plates 55, 56 due to the weight of the roll paper 13 and the shaft member 13*a*. After the shaft member 13*a* and the roll paper 13 have rolled together to the front ends of the drawer inclined surfaces 60, the shaft member 13*a* moves onto the top surfaces 50*a* of the rear horizontal parts 50 of the support members 46. At this time, since the top surfaces 50*a* and the drawer inclined surfaces 60 intersect at obtuse angles as seen from the left-right direction, the shaft member 13*a* is moved smoothly from the drawer inclined surfaces 60 onto the of the top surfaces 50*a* while vibration due to impact or the like is suppressed.

For comparison, in cases in which there are bumps between the drawer inclined surfaces 60 and the top surfaces 50*a*, the entire inkjet printer 11 is vibrated by the impact that occurs when the shaft member 13*a* falls with the roll paper 13 from the drawer inclined surfaces 60 to the top surfaces 50*a*, and there is a risk that the inkjet printer 11 will be adversely affected.

Figure 6:
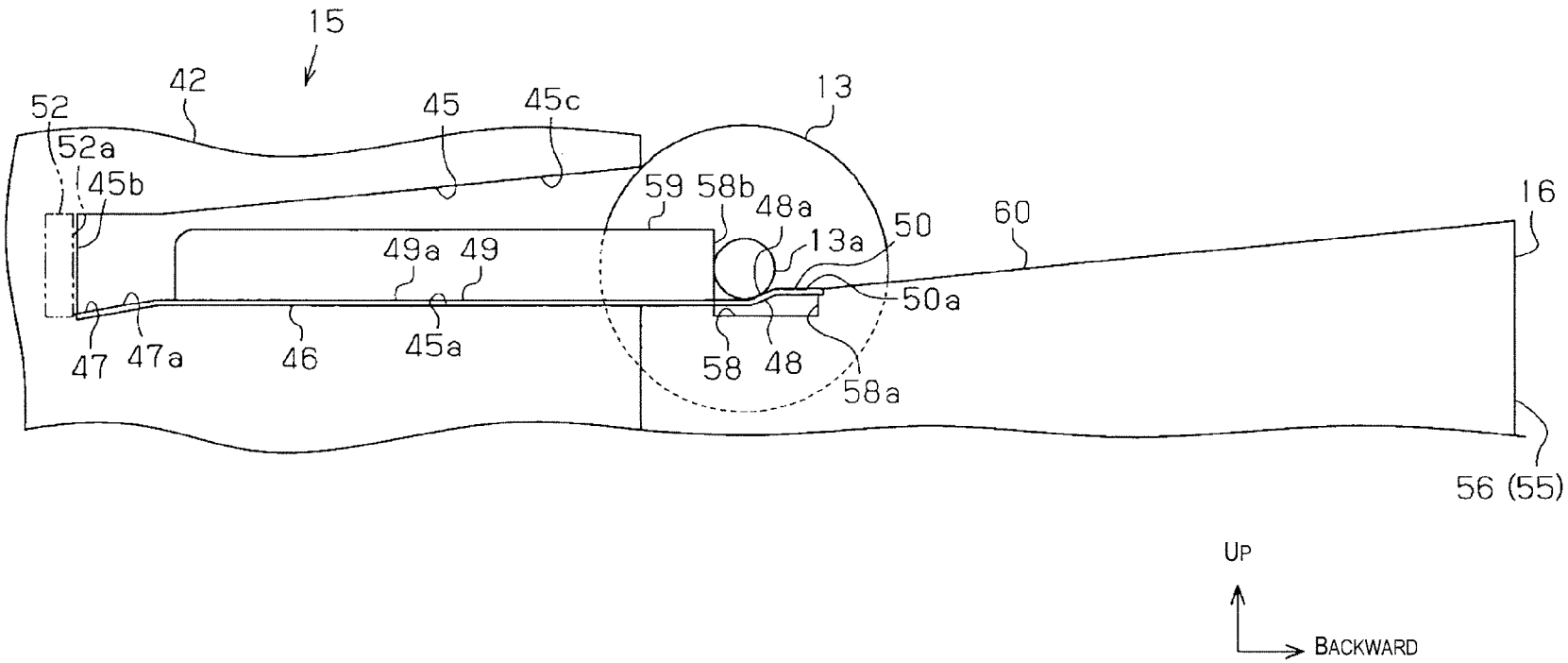
FIG. 6 is a schematic view showing the state when the shaft member of the roll paper is in contact with the front surface of the concavity of the drawer side plate in the same printer.

The shaft member 13*a*, having moved onto the top surfaces 50*a*, then rolls over the top surfaces 48*a* of the rear inclined parts 48 onto the top surfaces 49*a* of the front horizontal parts 49, and comes in contact with the front surface 58*b* of the concavity 58 of the drawer side plates 55, 56, as shown in FIG. 6. This contact causes the drawer member 16 to move slightly forward. The drawer member 16 is then slid forward toward the accommodated position, whereupon the rear surface 58*a* of the concavity 58 of the drawer side plates 55, 56 comes in contact with the shaft member 13*a* from behind.

Figure 7:
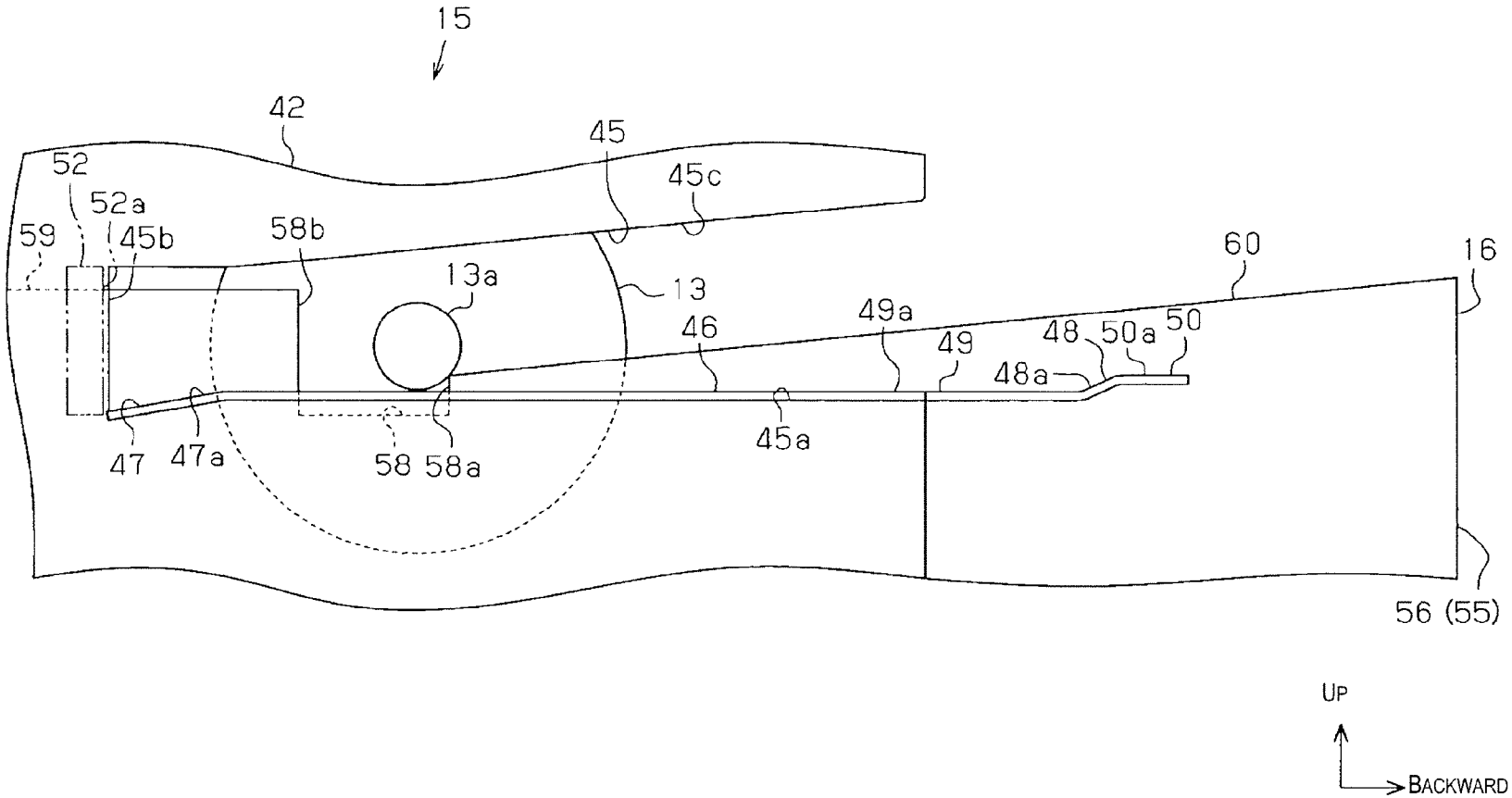
FIG. 7 is a schematic view showing the state when the shaft member of the roll paper is pushed forward by the rear surface of the concavity of the drawer side plate in the same printer.

Next, when the drawer member 16 is slid forward, a forward pressing force is applied to the shaft member 13*a* from the rear surface 58*a* as shown in FIG. 7. The shaft member 13*a* thereby quickly rolls forward over the top surfaces 49*a* of the front horizontal parts 49. When the drawer member 16 is moved to the accommodated position as shown in FIG. 8, the ends of the shaft member 13*a* are supported on the respective top surfaces 47*a* of the front inclined parts 47 of the support members 46 and brought in contact with the respective contact surfaces 52*a* of the contact members 52 and the front surface 45*b* of the recessed groove 45.

At this time, since the ends of the shaft member 13*a* are kept by the incline of the top surfaces 47*a* and by the weight of the roll paper 13 and shaft member 13*a* in a state of being constantly pressed by the contact surface 52*a* and the front surface 45*b*, the movement of the shaft member 13*a* in the forward-backward direction is regulated, i.e., the shaft member 13*a* is positioned. Furthermore, at this time, the drive gear 51 and the gear 13*b* of the shaft member 13*a* mesh together as shown in FIG. 4. The door 14 is then closed, and the setting of the roll paper 13 in the inkjet printer 11 is thereby complete.

When the drive gear 51 is appropriately rotatably driven forward or backward, the shaft member 13*a* is appropriately rotated via the gear 13*b* integrally with the roll paper 13 in the opposite direction of the drive gear 51, the roll paper 13 is therefore unwound toward the platen 20, and the slack of the roll paper 13 in the conveying route is taken up. The shaft member 13*a* is positioned in the left-right direction by flanges (not shown) provided to the shaft member 13*a*.

When the roll paper 13 is set in the inkjet printer 11 described above, after the shaft member 13*a* of the roll paper 13 is placed on the drawer inclined surfaces 60 of the drawer side plates 55, 56, in cases in which the drawer member 16 is slidably moved to the accommodated position before the shaft member 13*a* rolls and moves onto the top surfaces 50*a* of the rear horizontal parts 50 of the support members 46, the front ends of the drawer inclined surfaces 60 are in positions facing the top surfaces 47*a* of the front inclined parts 47 of the support members 46, and the shaft member 13*a* therefore rolls off the drawer inclined surfaces 60 and moves directly to the top surfaces 47*a*.

Figure 9:
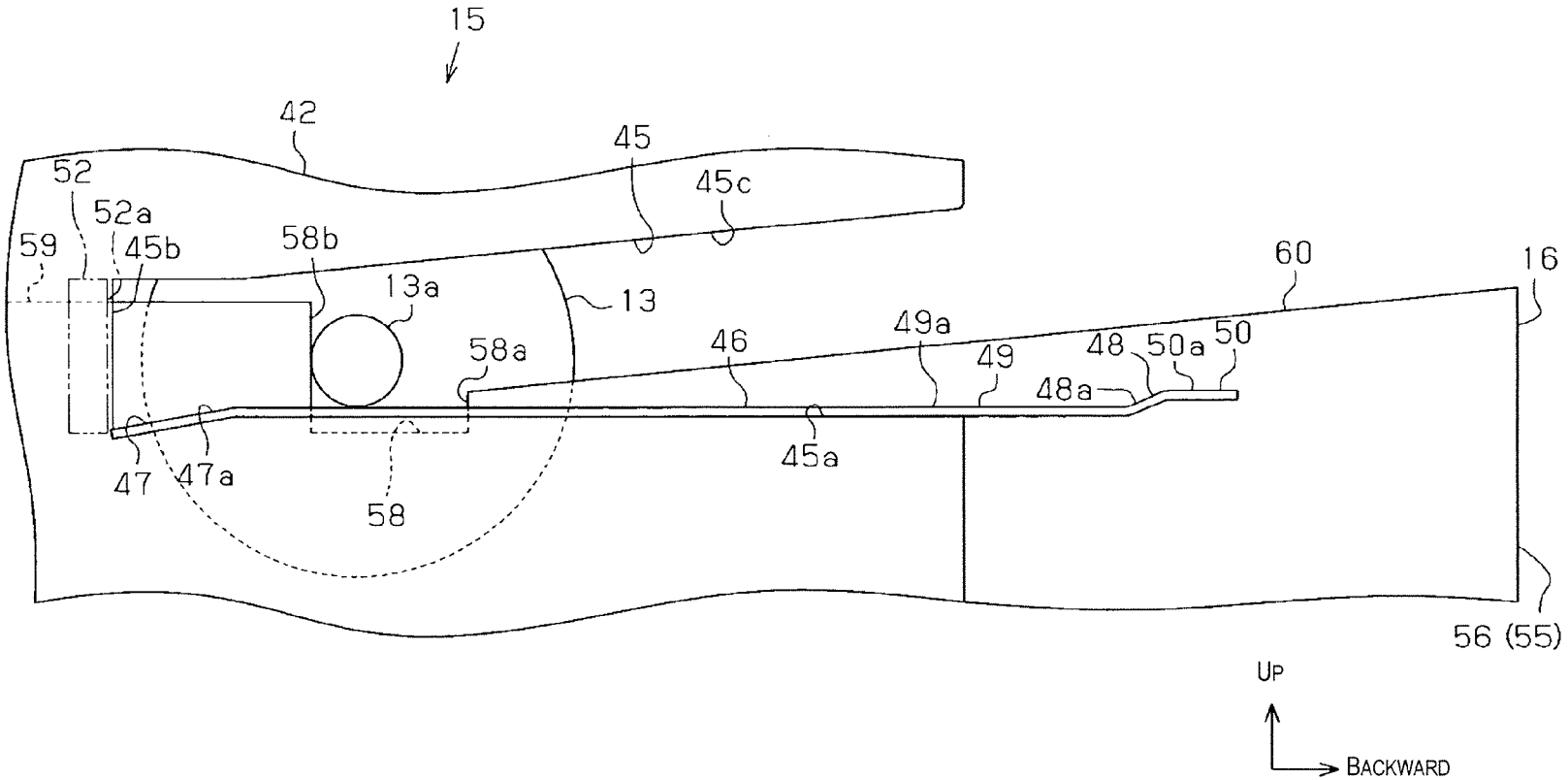
FIG. 9 is a schematic view showing the state when the shaft member of the roll paper is pushed rearward by the front surface of the concavity of the drawer side plate.

When the roll paper 13 set in the inkjet printer 11 is replaced, first, with the door 14 opened, the drawer member 16 accommodated in the roll paper accommodating unit 15 is pulled out rearward in the withdrawing direction. The front surfaces 58*b* of the concavities 58 of the drawer side plates 55, 56 then come in contact with the shaft member 13*a* from the front as shown in FIG. 9, and a rearward pressing force is applied to the shaft member 13*a* from the front surfaces 58*b*. The shaft member 13*a* is thereby moved off the top surfaces 47*a* onto the top surfaces 49*a* of the front horizontal parts 49, and is quickly rolled over the top surfaces 49*a* to the rear.

When the drawer member 16 is then moved to the pulled-out position as shown in FIG. 6, the shaft member 13*a* will have moved to the rear ends on the top surfaces 49*a* of the front horizontal parts 49. In this state, after the roll paper 13 is taken out with the shaft member 13*a*, the ends of the shaft member 13*a* of the roll paper 13 being replaced are placed on the drawer inclined surfaces 60 of the drawer side plates 55, 56, and are preferably set in the inkjet printer 11 in the same manner as described above.

According to the embodiment described in detail above, the following effects can be obtained.

(1) When the drawer member 16 is in the pulled-out position (the position shown in FIG. 5), the angle A, which is formed by the drawer inclined surfaces 60 and the top surfaces 50*a* of the rear horizontal parts 50 of the support members 46 as seen from the left-right direction (the direction in which the shaft member 13*a* extends), is an obtuse angle (about 170 degrees). Therefore, it is possible to effectively reduce the impact when the shaft member 13*a* of the roll paper 13 rolls off the drawer inclined surfaces 60 and moves onto the top surfaces 50*a*. Consequently, the roll paper 13 can be smoothly moved away from the drawer member 16 which can slide relative to the roll paper accommodating unit 15 in a state of supporting the shaft member 13*a* of the roll paper 13, toward the roll paper accommodating unit 15 provided with bearings for supporting the shaft member 13*a* of the roll paper 13.

(2) The drawer inclined surfaces 60 are inclined so that the surface portions nearer to the roll paper accommodating unit 15 (toward the front) are lower in the direction of gravity (the up-down direction) than the surface portions farther from the roll paper accommodating unit 15 (toward the rear). Therefore, since the shaft member 13*a* rolls due to its own weight toward the top surfaces 50*a* of the rear horizontal parts 50 of the support members 46 merely by the ends of the shaft member 13*a* of the roll paper 13 being placed on the drawer inclined surfaces 60, the shaft member 13*a* can be easily moved off the drawer inclined surfaces 60 onto the top surfaces 50*a*.

(3) The drawer member 16 is provided with rear surfaces 58*a* of the concavities 58 for applying a pressing force to the shaft member 13*a* which has moved off the drawer inclined surfaces 60 to a position on the top surfaces 49*a* of the front horizontal parts 49, the pressing force being applied toward the bearings (toward the front) together with the sliding movement of the drawer member 16 toward the roll paper accommodating unit 15 (toward the front). Therefore, after the shaft member 13*a* has moved off the drawer inclined surfaces 60 onto the top surfaces 49*a* of the front horizontal parts 49, a pressing force toward the bearings can be applied by the rear surfaces 58*a* of the concavities 58 to the ends of the shaft member 13*a* positioned on the top surfaces 49*a* merely be slidably moving the drawer member 16 toward the roll paper accommodating unit 15. As a result, the shaft member 13*a* can be easily led to the bearings.

(4) Bearing surfaces constituting the bearings for regulating the forward and backward movement (in the sliding direction of the drawer member 16) of the shaft member 13*a* and holding the shaft member 13*a* are configured by the top surfaces 47*a* of the front inclined parts 47 of the support members 46, the front surface 45*b* of the recessed groove 45, and the contact surface 52*a* of the contact member 52. Therefore, the shaft member 13*a* can be held by its own weight in position in the bearings.

(5) The drawer member 16 is provided with front surfaces 58*b* of the concavities 58 for applying a pressing force to the shaft member 13*a* which is being supported in the bearings, the pressing force being applied in the withdrawing direction along with the sliding movement of the drawer member 16 from the roll paper accommodating unit 15 in the withdrawing direction (rearward). Therefore, a pressing force in the withdrawing direction can be applied by the front surfaces 58*b* of the concavities 58 to the shaft member 13*a* supported in the bearings, merely by pulling the drawer member 16 out from the roll paper accommodating unit 15 in the withdrawing direction. As a result, the shaft member 13*a* can easily be taken out of the bearings.

MODIFICATIONS

The embodiment described above may be modified as follows.

At least one of either the front surfaces 58*b* or the rear surfaces 58*a* of the concavities 58 of the drawer side plates 55, 56 may be omitted.

The front inclined parts 47 of the support members 46 are formed into semicircular shapes corresponding to the bottom surfaces of the shaft member 13*a* as seen from the forward-backward direction, and the bearing surfaces constituting the bearings may be configured solely from the top surfaces 47*a* of the front inclined parts 47. In this case, since the movement of the shaft member 13*a* in the forward-backward direction can be regulated by the front inclined parts 47 alone, there is no need for the shaft member 13*a* to be in contact with the front surface 45*b* of the recessed groove 45.

The gear 13*b* of the shaft member 13*a* and the drive gear 51 may be omitted.

A roll-shaped plastic film, a roll-shaped cloth, a roll-shaped metal foil, or the like may be used instead of the roll paper 13 as the roll medium.

In the embodiment described above, the recording apparatus is specified as an inkjet printer 11, but a recording apparatus which sprays or discharges another liquid other than ink may also be used. The recording apparatus can be applied in various liquid-spraying apparatuses which comprise a liquid-spraying head or the like for discharging extremely small droplets. The term "droplets" refers to the state of the liquid discharged from the liquid-spraying apparatus, and includes that which leaves trails of grains, tears, or threads. The liquid referred to herein need only be a substance that can be sprayed by the liquid-spraying apparatus. For example, the material need only be in the state of a liquid which includes not only fluids such as liquids of high and low viscosity, sols, gels, other inorganic solvents, organic solvents, solutions, liquid resins, and liquid metals (metal melts); and liquids as one state of the substance; but also includes liquids containing functional materials composed of pigments, metal particles, or the like which are dissolved, dispersed, or mixed in a solvent. Typical examples of the liquids include ink such as the ink described in the embodiment described above, liquid crystal, and the like. The term "ink" used herein includes common water-based ink and oil-based ink, as well as gel ink, hot melt ink, and other various liquid compositions. Specific examples of the liquid-spraying apparatus include liquid-spraying apparatuses which spray a liquid containing an electrode material, a coloring material, or the like in the form of a dispersion or a solvent, which is used in the manufacture of liquid crystal displays, EL (electroluminescence) displays, surface-emitting displays, color filters, and the like, for example; liquid-spraying apparatuses which spray a biological organic substance used to manufacture biochips; liquid-spraying apparatuses which are used as precision pipettes and which spray a liquid as a test sample; printing apparatuses, micro dispensers, and the like. Further options which may be used include liquid-spraying apparatuses which spray lubricating oil at pinpoints onto watches, cameras, and other precision instruments; liquid-spraying apparatuses for spraying an ultraviolet curing resin or another transparent resin liquid onto a substrate in order to form a microscopic semispherical lens (optical lens) or the like used in an optical communication element or the like; and liquid-spraying apparatuses for spraying an acid, an alkali, or another etching liquid in order to etch a substrate or the like. The present invention can be applied to any one of these types of liquid-spraying apparatuses.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A roll medium feeding apparatus comprising:

a roll medium accommodating unit including a bearing that supports a shaft member of a roll medium; and a drawer member configured to slidably move relative to the roll paper accommodating unit, the roll medium accommodating unit including first support surfaces configured to support ends of the shaft member, the first support surfaces extending in a direction in which the drawer member slides from the bearing, and the drawer member including second support surfaces configured to support the ends of the shaft member, the second support surfaces intersecting with the first support surfaces at an obtuse angle relative to a direction in which the shaft member extends.

2. The roll medium feeding apparatus according to claim 1, wherein the second support surfaces are inclined so that a surface portion closer to the roll medium accommodating unit is lower in a direction of gravity than a surface portion farther away from the roll medium accommodating unit.

3. The roll medium feeding apparatus according to claim 1, wherein the drawer member includes an accommodating-direction pressing part configured to apply a pressing force to the shaft member, which has changed positions from the second support surfaces to the first support surfaces, the pressing force being applied toward the bearing as the drawer member slidably moves toward the roll medium accommodating unit.

4. The roll medium feeding apparatus according to claim 1, wherein the bearing has a bearing surface that regulates the movement of the shaft member in the sliding direction of the drawer member, and holds the shaft member.

5. The roll medium feeding apparatus according to claim 1, wherein the drawer member includes a withdrawing-direction pressing part configured to apply a pressing force in a withdrawing direction to the shaft member supported by the bearing, the pressing force being applied as the drawer member slidably moves in a direction of withdrawing from the roll medium accommodating unit.

6. A recording apparatus comprising:

the roll medium feeding apparatus according to claim 1; and a recording unit that performs a recording process on the roll medium fed from the roll medium feeding apparatus.

* * * * *